US005131725A

United States Patent [19]

Rowlett et al.

[11] Patent Number: 5,131,725

[45] Date of Patent: Jul. 21, 1992

[54] ROTATABLE CUTTING TOOL HAVING AN INSERT WITH FLANGES

[75] Inventors: Don C. Rowlett, Bedford; Stephen P. Stiffler, New Enterprise; Wayne H. Beach, Roaring Spring, all of Pa.

[73] Assignee: Kennametal Inc., Latrobe, Pa.

[21] Appl. No.: 578,708

[22] Filed: Sep. 4, 1990

[51] Int. Cl.[5] ..... E21B 35/18

[52] U.S. Cl. ..... 299/79; 175/427; 299/86

[58] Field of Search ..... 299/79, 86, 91-93; 175/354, 410, 411

[56] References Cited

U.S. PATENT DOCUMENTS

| | | | |
|---|---|---|---|
| Re. 30,807 | 12/1981 | Elders | 299/86 |
| 3,356,418 | 12/1967 | Healey et al. | 299/91 |
| 3,361,481 | 1/1968 | Maddock | 299/86 |
| 3,476,438 | 8/1969 | Bower, Jr. | 299/86 |
| 3,652,130 | 3/1972 | Elders | 299/86 |
| 3,746,396 | 7/1973 | Radd | 299/10 |
| 3,801,158 | 4/1974 | Radd et al. | 299/86 |
| 3,833,264 | 9/1974 | Elders | 299/86 |
| 3,833,265 | 9/1974 | Elders | 299/86 |
| 4,065,185 | 12/1977 | Elders | 299/86 |
| 4,729,603 | 3/1988 | Elfgen | 299/93 |
| 4,981,328 | 1/1991 | Stiffler et al. | 299/79 |

FOREIGN PATENT DOCUMENTS

| | | | |
|---|---|---|---|
| 122893 | 10/1984 | European Pat. Off. | 299/91 |
| 436433 | 12/1984 | Sweden | 299/86 |
| 825924 | 4/1981 | U.S.S.R. | 299/79 |
| 899916 | 1/1982 | U.S.S.R. | 299/79 |
| 2101657 | 1/1983 | United Kingdom | 299/79 |

OTHER PUBLICATIONS

Kennametal Drawing DEV-C-1736, Jan. 1980.

*Primary Examiner*—David J. Bagnell
*Attorney, Agent, or Firm*—John J. Prizzi

[57] ABSTRACT

A rotatable cutting tool for impacting and fragmenting a substrate. The tool has a tool body containing a valve seat in the forward end thereof wherein a hard insert affixes to the tool body within the valve seat. The hard insert comprises an integral tip segment and an integral axially rearward segment joined to the tip segment by an integral mediate segment. A trio of generally vertically disposed flanges project radially outward from the mediate segment. The flanges are integral with the mediate portion. Each flange presents at least one side surface. During operation, the substrate fragments impinge against the side surface to urge the tool to rotate about its central longitudinal axis.

30 Claims, 2 Drawing Sheets

ROTATABLE CUTTING TOOL HAVING AN INSERT WITH FLANGES

BACKGROUND OF THE INVENTION

The invention is directed to a rotatable cutting tool having a hard carbide insert affixed to a socket in an elongate body, and more specifically, to such a rotatable cutting tool designed so as to provide for improved performance characteristics. These characteristics include increased wear cycle, more efficiency through continuous penetration throughout the wear cycle, increased protection of the steel braze joint beneath the carbide, continued penetration in tougher milling conditions, and better bit rotation.

In the past, rotatable cutting tools have been put to a number of uses including use as a road planing tool in a road planing machine. Typically, a road planing machine includes a rotatable drum having a plurality of blocks affixed thereto. Each block contains a central bore therein. Road planing tools typically comprise an elongate steel body with a hard cemented carbide tip brazed into a socket contained in the forward end of the steel body. The steel body includes a reduced diameter portion adjacent the rearward end thereof. A retainer is adjacent the reduced diameter portion of the steel body. The retainer functions to rotatably retain the rotatable cutting tool within the bore of the mounting block during operation.

In operation, the drum rotates so as to cause the rotatable cutting tools to impact the road surface. The tools impacting the surface cut and break up the road surface. The road surface fragments are disposed of in a suitable fashion.

During the operation of the drum, each rotatable cutting tool rotates about its central longitudinal axis. It is important that the tool continue to rotate because adequate rotation is important to good performance. Heretofore, a number of designs of rotatable cutting tools have been used or described in patents and/or printed publications. However, most of these designs do not provide specific structure on the hard insert to enhance rotation. For example, U.S. Pat. No. 4,216,832 to Stephenson et al. concerns a rotatable tool wherein FIG. 10 illustrates a conventional hard cemented carbide insert. This insert includes a tip section. A generally frusto-conically shaped section is axially rearward of the tip section. A generally cylindrical flange section is axially rearward of the frusto-conically shaped section. A valve seat section is contiguous with and is positioned axially rearwardly of the generally cylindrical flange section. This cemented carbide insert does not present structure that enhances tool rotation.

Soviet Author's Certificate No. 899,916 concerns a rotatable cutting tool with a hard insert. The insert has a forward tip section with a generally conical shape. A cylindrical section is axially rearward of and contiguous with the tip section. A flange section is axially rearward of and contiguous with the cylindrical section. A radius joins the flange and cylindrical sections. A projection is axially rearward of and contiguous with the flange section. This hard insert does not show any structure that enhances the rotation of the tool.

European Patent Application No. 0122893 to Larsson et al. shows several styles of rotatable cutting bits. FIG. 1 shows one style. FIG. 2 shows another style. FIGS. 3 and 4 show a third style in which the hard insert has a tip section of a generally conical shape. A mediate section joins the tip section to a rearward section. The hard insert attaches at the rearward section to the bit body.

Swedish Patent Publication No. 436,433 to Lundell et al. shows two styles of rotatable cutting bits. The style shown by FIGS. 2. and 3 has a hard insert containing a recess in the rear surface. The recess has a shape that is complementary to that of a projection at the forward end of the steel body.

U.S. Pat. No. 4,497,520 to Ojanen concerns a rotatable cutting bit. The Ojanen patent says that it depicts a hard insert with coaxially aligned and integral sections. This hard insert does not show any structure or present any configuration that directly enhances tool rotation.

U.S. Pat. No. 4,725,099 to Penkunas et al. concerns a rotatable cutting bit. This patent says that it depicts a rotatable cutting bit of improved geometry. This bit has a hard insert with a conically shaped tip section, a base section contiguous with a first intermediate section, and a second intermediate section contiguous with the tip and first intermediate sections. This patent does not present any hard insert with a configuration that enhances the rotation of the tool.

U.S. Pat. No. 4,729,603 to Elfgen discloses a hard carbide insert having a series of circumferentially spaced grooves to provide a land-groove arrangement. These grooves serve to carry away material and assist to some degree in the rotation of the tool. Kennametal, Inc. once manufactured a hard carbide insert which utilized grooves in the conical portion of the insert. This hard carbide insert is shown in Kennametal Drawing DEV-C-1736 dated Jan. 31, 1980. Like the insert Elfgen depicts, these grooves serve to carry away material and assist to some degree in the rotation of the tool.

SUMMARY OF THE INVENTION

It is an object of the invention to provide an improved rotatable cutting tool having a cemented carbide insert affixed to the forward end of the tool body.

It is another object of the invention to provide an improved rotatable cutting tool having a cemented carbide insert affixed thereto wherein the insert provides for an increased wear cycle.

It is another object of the invention to provide an improved rotatable cutting tool having a cemented carbide insert affixed thereto wherein the insert provides efficiency through continuous penetration throughout the wear cycle.

It is another object of the invention to provide an improved rotatable cutting tool having a cemented carbide insert affixed thereto wherein the insert provides increased protection of the steel tool body and braze joint beneath the carbide.

It is another object of this invention to provide an improved rotatable cutting bit having a cemented carbide insert affixed thereto wherein the insert is reinforced to withstand tougher milling conditions.

Finally, it is an object of the invention to provide an improved rotatable cutting bit having a cemented carbide insert affixed thereto wherein the insert aids in bit rotation thereby assisting in the even wear of the carbide insert.

The invention in one form thereof is a rotatable cutting tool for impacting and fragmenting a substrate. The tool comprises a tool body with a forward end to which affixes a hard insert. The hard insert includes a tip segment, a rearward segment and a mediate segment contiguous with both the tip and rearward segments. A plurality of flanges extend from the mediate segment. Each flange presents at least one side surface oriented so that during impact the substrate fragments impinge against the side surface thereby urging the tool to rotate about its central longitudinal axis.

The invention in another form thereof is a hard insert for use in a rotatable cutting tool. The insert affixes to the forward end of the tool. The hard insert comprises a plurality of coaxially aligned integral segments. These segments include a tip segment, a rearward segment, and a mediate segment. The mediate segment is contiguous at its axially forward end with the tip segment and is contiguous at its axially rearward end with the rearward segment. The hard insert further includes a plurality of generally vertically disposed outwardly radially projecting flanges. The flanges are integral with and protrude from the mediate segment.

These and other aspects of the present invention will become more apparent upon review of the drawings, which are briefly described below, in conjunction with the detailed description of specific embodiments of the invention.

DETAILED DESCRIPTION OF THE SPECIFIC EMBODIMENTS

Figure 1:
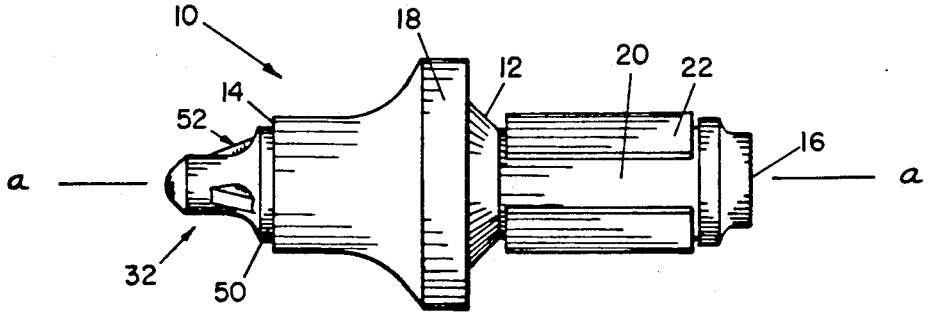
FIG. 1 is a side view of one specific embodiment of the rotatable cutting tool of the invention.

Referring to the drawings, FIG. 1 illustrates one specific embodiment of a rotatable cutting tool, generally designated as 10, of the invention. Rotatable cutting bit 10 includes an elongate steel body 12. Steel body 12 has a forward end 14 and a rearward end 16. Steel body 12 has a central longitudinal axis a-a shown in FIG. 1. Elongate steel body 12 further includes an enlarged diameter portion 18 midway between the forward end 14 and rearward end 16. Steel body 12 has a reduced diameter portion 20 adjacent rearward end 16. An elongate split ring cylindrical retainer 22 is loosely positioned and contained within the reduced diameter portion 20 of steel body 12.

Figure 2:
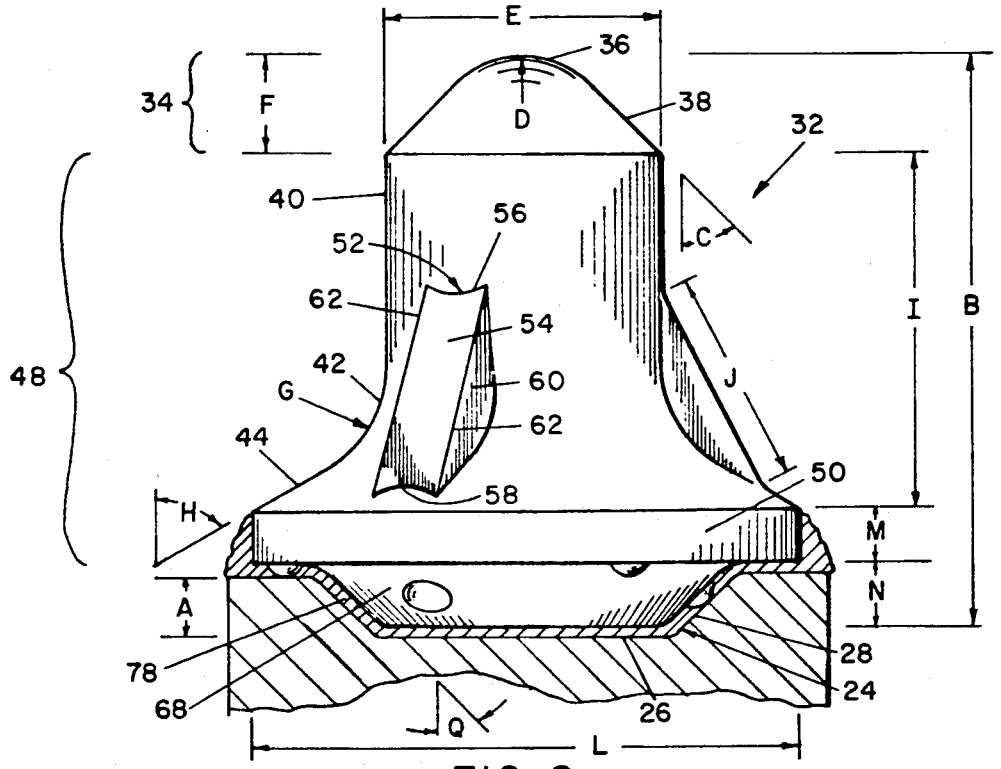
FIG. 2 is a side view of the cemented carbide insert attached to the forward end of the elongate steel body of FIG. 1 with a portion of the steel body cut away to expose the braze joint between the carbide insert and the steel body.

Steel body 12 further contains a valve seat 24 (see FIG. 2) in the forward end 14 thereof. Valve seat 24 includes a generally circular bottom surface 26 and a contiguous generally frusto-conical annular surface 28. The valve seat 24 defines a volume of a generally frusto-conical shape. The depth A of the valve seat 24 is equal to about 0.079 inches.

Rotatable cutting bit 10 further includes a cemented carbide insert generally designated as 32. Cemented carbide insert 32 affixes to the forward end 14 of steel body 12 by brazing as will become more apparent hereinafter. The overall axial length B of cemented carbide insert 32 is about 0.720 inches.

Cemented carbide insert 32 includes a tip portion 34 comprising a semi-spherical section 36 and a frusto-conically shaped section 38. The frusto-conical section 38 has an angle of taper of C. Angle C of this specific embodiment is equal to approximately 45° so that the included angle of taper of conical tip portion 34 is approximately 90°. The semi-spherical section 36 is radiused at a radius of D, which in this specific embodiment is about 0.125 inches. The maximum diameter E of tip portion 34 is about 0.341 inches. The axial length F of tip portion 34 is about 0.119 inches.

Cemented carbide insert 32 further includes an integral mediate cylindrical section 40. Mediate cylindrical section 40 is contiguous at its axially forward end with conical tip portion 34. Mediate cylindrical section 40 is contiguous at its axially rearward end with an integral mediate concave section 42. Mediate concave section 42 is axially rearward of mediate cylindrical section 40. Mediate concave section 42 presents a continuous concave surface with a radius of curvature G equal to about 0.187 inches. Mediate concave portion 42 is contiguous at its axially rearward end with an integral mediate frusto-conical section 44. Mediate frusto-conical section 44 has an angle to taper H equal to about 60°. This angle is approximately equal to the wear angle on the cemented carbide insert for this type of tool. In this specific embodiment, the included angle of taper of the mediate frusto-conical section 44 is about 120°. However, it is contemplated that this included angle may range between about 110° and about 130°. The overall axial length I of the mediate cylindrical section 40, mediate concave section 42 and mediate frusto-conical section 44 is about 0.452 inches. Integral mediate frusto-conical section 44 is contiguous at its axially rearward end with an integral mediate barrel section 50. Mediate barrel section 50 is of a generally cylindrical shape.

These four mediate sections of the cemented carbide insert 32; namely, the mediate cylindrical section 40, the mediate concave section 42, the mediate frusto-conical section 44 and the mediate barrel section 50, together comprise what can be considered to be a mediate portion, generally designated as 48.

Cemented carbide insert 32 further has a trio of generally vertically disposed ribs or flanges 52. These flanges 52 are protrusions that are molded as an integral part of the insert 32. These flanges 52 project outwardly and radially from mediate section 48. Flanges 52 are circumferentially equi-spaced about cemented carbide insert 32. Flanges 52 are contiguous with and extend between mediate cylindrical section 40 and mediate frusto-conical section 44. Each flange 52 presents a top surface 54 having opposite upper and lower ends 56, 58, respectively, and opposite side surfaces 60. The upper end 56 is contiguous with and blends with the mediate cylindrical section 40. The lower end 58 is contiguous with and blends with the mediate frusto-conical portion 44. Top surface 54 further presents opposite sides edges 62.

Top surface 54 may take on one of several configurations. The specific embodiment shows top surface 54 as being linear or planar. However, top surface 54 can be internally radiused or internally stepped. Top surface 54 has a maximum length J of one-half of the axial length B of insert 32 which equates to a maximum length of about 0.360 inches. Top surface 54 has a maximum width K of two-thirds diameter E which equates to a maximum width of about 0.227 inches.

Each side surface 60 is contiguous with each side edge 62. Each side surface 60 projects generally radially inwardly from side edge 62 towards mediate section 48. Side surface 60 is generally planar. The angle of orientation between each side surface 60 and its corresponding top surface 54 is between about 92° and about 135°. The preferred angle of orientation is about 100°.

Integral cylindrical section 50 further includes a bottom surface 66 (see FIG. 3) which faces axially rearwardly. Bottom surface 66 is of a generally circular configuration. The diameter L of cylindrical section 50 is about 0.680 inches. The axial length M of cylindrical section 50 is about 0.07 inches. A boss 68 projects axially rearwardly from bottom surface 66 a distance N of about 0. 079 inches from bottom surface 66. Boss 68 includes an annular frusto-conically shaped side surface 70 which terminates in a generally flat bottom surface 72. The maximum diameter 0 of the boss 68 is about 0.509 inches. The diameter P of the flat bottom surface 72 of boss 50 is about 0.350 inches. In this specific embodiment, the angle of taper Q of the frusto-conical surface 70 is about 45°. However, it is contemplated that it may range between about 42° to about 48°. The configuration of the boss 68 corresponds to the configuration of valve seat 24.

Figure 3:
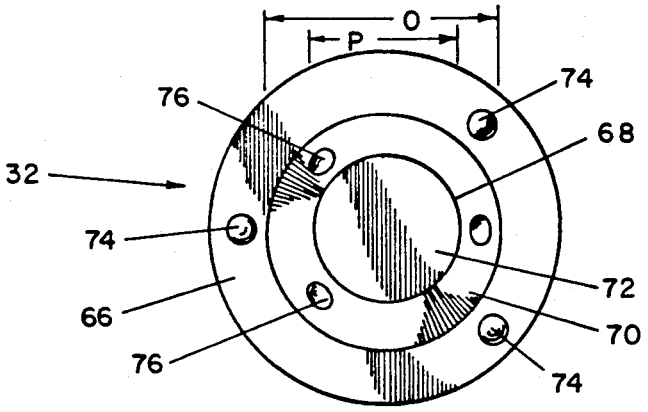
FIG. 3 is a bottom view of the cemented carbide insert of FIGS. 1 and 2.

A trio of bumps 74 projects a distance equal to between about 0.005 inches and about 0.008 inches from the flat bottom surface 66. Bumps 74 are generally equispaced approximately 120° apart. A second trio of bumps 76 projects a distance between about 0.005 inches and about 0.008 inches from the frusto-conical side surface 70 of boss 68. Bumps 76 are generally equispaced apart approximately 120°. The relative orientation of bumps 74 and bumps 76 is such that one set is offset about 60° with respect to the other set. In other words, each bump 74 is offset about 60° from its adjacent bump 76 as illustrated in FIG. 3.

Cemented carbide insert 32 affixes to steel body 12 by brazing whereby the volume of the valve seat 24 contains the boss 68. It is apparent from FIG. 2 that the bumps 74 and 76 maintain the thickness of the braze joint 78 between the cemented carbide insert 32 and steel body 12 at a uniform thickness. Bumps 74 maintain the uniform spacing between the bottom surface 66 of cemented carbide insert 32 and the forward end of the steel body 12. The thickness of the braze joint 78 between bottom surface 66 and cemented carbide insert 32 is approximately equal to the height of the bumps 74. However, this may vary slightly depending upon whether a thin layer of braze alloy is sandwiched between the bumps 74 and forward end 14 of the steel body 12. Bumps 76 maintain the uniform spacing between the frusto-conical surface 70 of the boss 68 and the frusto-conical surface 28 of the valve seat 24. The thickness of the braze joint between frusto-conical surface 70 and frusto-conical surface 28 is approximately equal to the height of the bumps 76. However, this may vary slightly depending on whether a thin layer of braze alloy is sandwiched between the bumps 76 and the frusto-conical surface 28 of the valve seat 24. Both sets of bumps 74 and 76 cooperate to maintain the uniform spacing between the flat surface 26 of the valve seat 24 and the flat surface 72 of the boss 68. As can be appreciated, bumps 74 and 76 maintain the uniform thickness of the braze joint.

Figure 4:
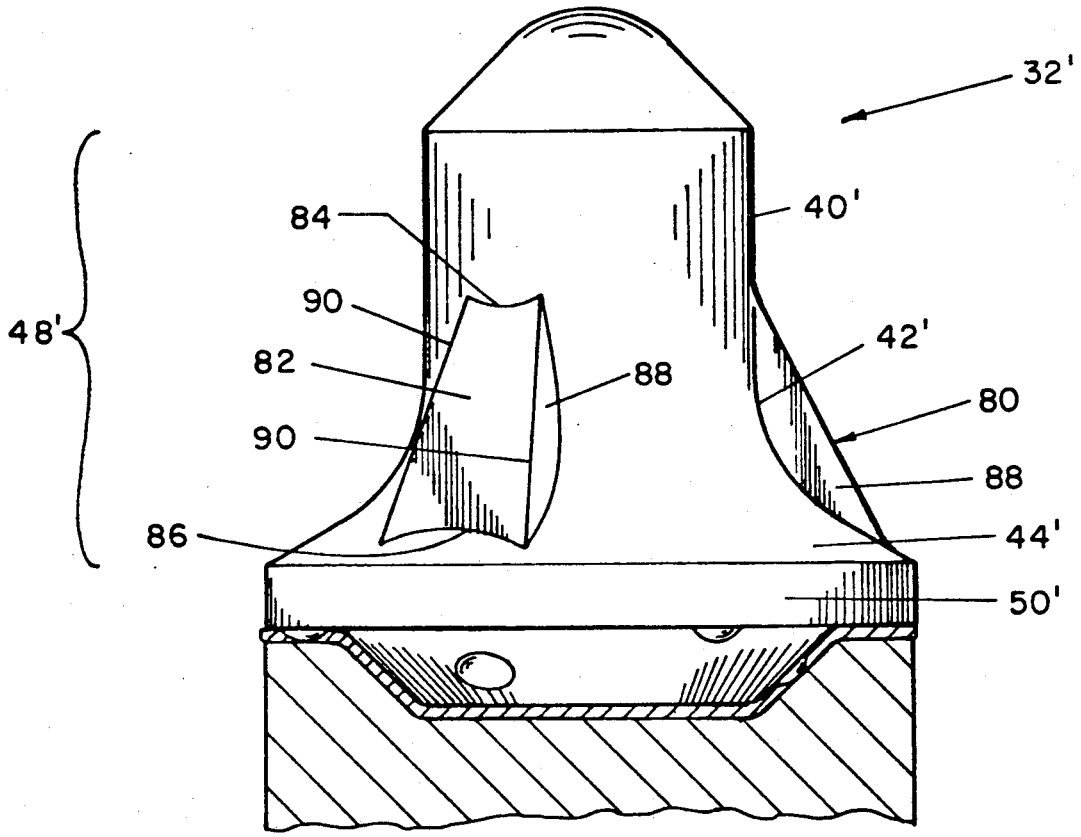
FIG. 4 is a side view of another specific embodiment of the hard insert of the present invention attached to the forward end of an elongate steel, body with a portion of the steel body cut away to expose the braze joint between the hard insert and the steel body.
Figure 5:
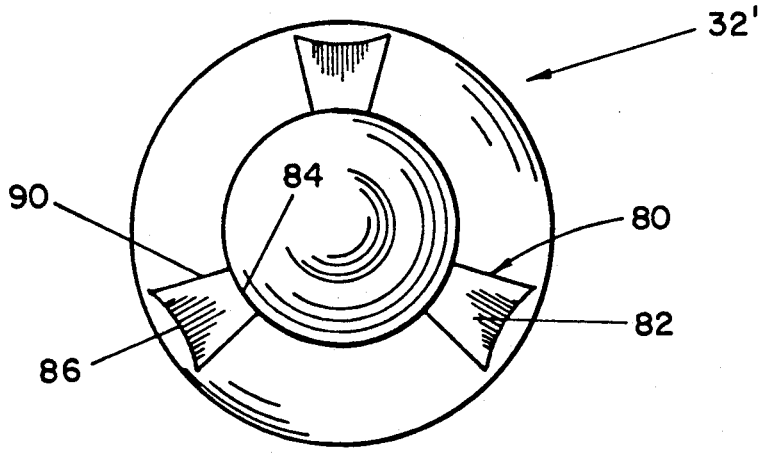
FIG. 5 is a top view of the hard insert of FIG. 4.

FIGS. 4 and 5 depict a second specific embodiment of the cemented carbide insert. Due to the structural similarities in many respects between the hard carbide insert of the first and second specific embodiments, common structural elements will be identified with the same references numeral, except that the reference numeral will be primed when referring to the second specific embodiment. FIGS. 4 and 5 depict cemented carbide insert 32'. Cemented carbide insert 32' contains the basic structural features of cemented carbide insert 32. The primary difference resides in the configuration of the flanges.

Cemented carbide insert 32' presents of trio of generally vertically disposed ribs or flanges, generally designated as 80. These flanges 80 project outwardly and radially from the mediate section 48'. Flanges 80 are circumferentially equal-spaced about cemented carbide insert 32'. Flanges 80 are contiguous with and extend between the mediate cylindrical section 40' and mediate frusto-conical section 44'. Each flange 80 presents a top surface 82 having opposite upper and lower ends 84, 86, respectively and opposite side surfaces 88. The upper end 84 is contiguous with and blends with the mediate cylindrical section 40' The lower end 86 is contiguous with and blends with the mediate frusto-conical section 44'. Top surface 82 further presents opposite side edges 88. Top surface 82 may take on one of several configurations. The specific embodiment shows top surface 82 as being linear or planer. However, top surface 82 can be internally radiused or internally stepped. Top surface 82 has a maximum length of one half of the axial length of insert 32', which equates to a maximum length of about 0.360 inches. The width of top surface 82 at the upper end 84 is a minimum of two thirds of the maximum tip diameter which equates to a minimum width of about 0.227 inches. As illustrated in FIGS. 4 and 5, the width of top surface 82 at lower end 86 is greater than at the upper end 84. The maximum width of top surface 82 at lower end 86 is three times the width at the upper end 84. In this specific embodiment, the maximum width of top surface 82 at lower end 86 is about 0.681 inches.

Each side surface 88 is contiguous with each side edge 90. Each side surface 88 projects radially inwardly from side edge 90 toward mediate section 48'. Side surface 88 is generally planer. The angle of orientation between each side surface 88 and its corresponding top surface 82 is between 92° and 135°. The preferred angle of orientation is 100°.

In these specific embodiments, the cemented carbide tip may be composed of anyone of the standard tungsten carbide-cobalt compositions conventionally used for construction applications. The specific grade of cemented carbide depends upon the particular application to which one puts the tool. For example, for rotatable tools used in road planing, it may be desirable to use a standard tungsten carbide grade containing about 5.7 w/o cobalt (balance WC) and having a Rockwell A hardness of about 88.2. The cemented carbide tip can be made by injection molding techniques, as well as by powder compaction techniques. When made by the injection molding technique all of the hard insert is molded including the flanges. As it well known to those of ordinary skill in the art, at the junctures of the various surfaces described on the carbide tip, rounds at the edges, chamfers, fillets and/or pressing flats may be provided, where appropriate, to assist in manufacturing and/or provide added strength to the structure.

In regard to all of the specific embodiments, it is preferred that a high temperature braze material be used in joining the cemented carbide insert to ferrous body so that braze joint strength is maintained over a wide temperature range. The preferred braze material is a HIGH TEMP 080 manufactured and sold by Handy & Harman, Inc., 859 Third Avenue, New York, N.Y. 10022. The nominal composition and the physical properties of the Handy & Harman HIGH TEMP 080 braze alloy are set forth below:

| | | | |
|---|---|---|---|
| NOMINAL COMPOSITION: | Copper | 54.85% | ±1.0 |
| | Zinc | 25.0 | ±2.0 |
| | Nickel | 8.0 | ±0.5 |
| | Manganese | 12.0 | ±0.5 |
| | Silicon | 0.15 | ±0.05 |
| | Total Other Elements | 0.15 | |
| PHYSICAL PROPERTIES: | Color | Light Yellow | |
| | Solidus | 1575° F. (855° C.) | |
| | Liquidus (Flow Point) | 1675° F. (915° C.) | |
| | Specific Gravity | 8.03 | |
| | Density (lbs/cu.in.) | .290 | |
| | Electrical Conductivity (% I.A.C.S.) | 6.0 | |
| | Electrical Resistivity (Microhm-cm.) | 28.6 | |
| | Recommend Brazing Temperature Range | 1675-1875° F. (915-1025° C.) | |

Acceptable braze joints may be achieved by using braze rings positioned against the bottom surface of the cylindrical portion so as to be adjacent to the location wherein the boss projects from the bottom surface. The circular hole in the braze ring is of such a dimension so that the boss projects therethrough. The assembly is then brazed by conventional induction brazing techniques which, in addition to brazing a tip to the steel body, also hardens the steel which may be of any of the standard steels used for rotatable mining and construction tool bodies. After the brazing and hardening step, the steel is tempered to a hardness of Rockwell C 40–45.

The braze joint of these specific embodiments presents a configuration so as to better withstand the stresses exerted thereon during operation. A copending patent application owned by applicants' assignee further describes this structural aspect. This patent application is Ser. No. 07/396,885 filed Aug. 22, 1989and issued as U.S. Pat. No. 4,981,328, and is entitled ROTATABLE CUTTING TOOL. The text of this patent application is hereby incorporated by reference herein.

The bumps act to provide for a braze joint of a more uniform thickness which provides a braze joint with a consistent, predictable strength. Thus, the configuration of the braze joint as well as the consistency of the braze joint help provide the improved performance of this rotatable cutting tool. Depending upon the specific application, the height of one set of bumps may be different from the height of the other set.

Another factor which influences the integrity of the braze joint is the precision with which the cemented carbide insert is centered within the valve seat. In a production line environment, it is important that the insert easily and precisely centers within the valve seat. The present embodiments provide two structural features that assist with the easy and precise centering operation. More specifically, the complementary frustoconical surfaces of the boss and the valve seat assists with the precise positioning of the cemented carbide insert in the valve seat. The bumps on the side of frustoconical surface of the boss cooperate with the frustoconical surface of the valve seat to assist with the precise positioning of the insert in the valve seat.

One can cold form the valve seat in the tool body to its final dimension because to the shallowness thereof. The shallowness is a result of this design which eliminates the need to machine any portion of the valve seat. Hence, the manufacturing cost associated with the steel body of the specific embodiments is meaningfully reduced over rotatable cutting tools which require machining of the valve seat.

The flanges of the cemented carbide insert assist with the rotation of the complete rotatable cutting tool. A typical use for the rotatable cutting tool of the present invention, such as road planing, demonstrates this feature. A road planing machine includes a rotatable drum with a plurality of blocks. Each block contains a longitudinal bore therein. The blocks mount, such as by welding, to the drum that the central longitudinal axis of the block bore is skewed from the general direction of rotation. A single rotatable cutting tool rotatably mounts in the longitudinal bore of its corresponding block. When within the block, the spring retainer 22 expands so as to frictionally engage the bore wall, thereby rotatably mounting the tool in the block.

In operation, the road planing drum rotates so that each rotatable cutting tool impacts the substrate at the cemented carbide insert. The substrate is broken and fractured by this impact. The fragments of substrate travel along the longitudinal surface of the cemented carbide insert. Because the blocks are skewed, the tool is skewed relative to the direction of rotation. In other words, the tools impact the road surface at an angle from their central longitudinal axis. Consequently, the cemented carbide insert enters the substrate at an angle so that the fragments impinge upon the side surfaces (60, 88) of the flanges (52, 80). This impingement exerts a side loading on the flanges. This side loading of the side surfaces urges the tool to rotate about its central longitudinal axis.

Other specific embodiments of the invention will be apparent to those skilled in the art from a consideration of this specification or practice of the invention disclosed herein. One must not limit the scope of the invention to the specific shapes and configurations set forth in the specific embodiments. It is the intention of the inventors that the specification and specific embodiments be exemplary only, with the true scope and spirit of the invention being indicated by the following claims.

What is claimed is:

1. A rotatable cutting tool for impacting and fragmenting a substrate, the tool comprising:

a tool body having a forward end to which a hard insert is affixed, said hard insert including:

an axially forward tip segment, an axially rearward segment, a mediate segment contiguous with both the tip segment and the axially rearward segment; and a plurality of radial flanges extending from the mediate segment and all of said flanges being axially forward of said forward end of said tool body, each flange presenting at least one side surface oriented so that during impact the substrate fragments impinge against the side surface thereby urging the tool to rotate about its central longitudinal axis.

2. The rotatable cutting tool of claim 1 wherein the forward end of the tool body contains a valve seat defining a volume.

3. The rotatable cutting tool of claim 2 wherein the axially rearward segment generally corresponds to the shape of the valve seat, and said rearward segment being contained within the volume of the valve seat.

4. The rotatable cutting tool of claim 1 wherein the radial flanges are generally equi-spaced about said insert.

5. The rotatable cutting tool of claim 1 wherein said mediate segment includes:

an integral mediate cylindrical portion contiguous with and positioned axially rearwardly of the tip segment;

an integral mediate concave portion contiguous with and positioned axially rearwardly of the mediate cylindrical portion;

an integral mediate frusto-conical portion contiguous with and positioned axially rearwardly of the mediate concave portion; and an integral mediate barrel portion contiguous with and positioned axially rearwardly of the mediate frusto-conical portion.

6. The rotatable cutting tool of claim 1 wherein said hard insert is affixed to the tool body by brazing.

7. The rotatable cutting tool of claim 1 wherein each flange includes a top surface and opposite side surfaces contiguous with said top surface and mediate segment.

8. The rotatable cutting tool of claim 7 wherein said top surface is generally planar.

9. The rotatable cutting tool of claim 7 wherein said top surface is of a concave shape.

10. The rotatable cutting tool of claim 7 wherein each side surface is disposed with respect to the top surface at an angle between about 92° and about 135°.

11. A hard inset for use in a rotatable cutting tool wherein the insert is affixed to the forward end of the tool, the hard insert comprising:

a plurality of coaxially aligned and integral segments including a tip segment, a rearward segment, and a mediate segment which is contiguous at the axially forward end thereof with the tip segment and at the axially rearward end thereof with the rearward segment; and a plurality of generally vertically disposed outwardly radially projecting flanges integral with and protruding from the mediate segment, and all of said flanges being axially forward of the forward end of the tool when the insert is affixed to the tool.

12. The hard insert of claim 11 wherein the flanges are generally equi-spaced about said hard insert.

13. The hard insert of claim 11 wherein the mediate segment comprises:

an integral mediate cylindrical portion contiguous with and positioned axially rearwardly of the tip portion;

an integral mediate concave portion contiguous with and positioned axially rearwardly of the mediate cylindrical portion;

an integral mediate frusto-conical portion contiguous with and positioned axially rearwardly of the mediate concave portion; and an integral mediate barrel portion contiguous with and positioned axially rearwardly of the mediate frusto-conical portion.

14. The hard insert of claim 11 wherein each flange includes a top surface joining generally planar side surfaces contiguous with the mediate segment and radially extending from the top surface.

15. The hard insert of claim 14, wherein the top surface has opposite upper and lower ends.

16. The hard insert of claim 15 wherein the width of the upper end of the top surface is equal to the width of the lower end of the top surface.

17. The hard insert of claim 15 wherein the width of the upper end of the top surface is less than the width of the lower end of the top surface.

18. The hard insert of claim 17 wherein each side surface is disposed relative to the top surface at an angle between about 92° and about 135°.

19. A rotatable cutting tool for impacting and fragmenting a substrate, the tool comprising:

a tool body having a forward end to which a hard insert is affixed, the forward end of the tool body contains a valve seat defining a volume, said hard insert including:

an axially forward tip segment, an axially rearward segment, a mediate segment contiguous with both the tip segment and the axially rearward segment, the axially rearward segment generally corresponds to the shape of the valve seat, and said rearward segment being contained within the volume of the valve seat;

a plurality of radial flanges extending from the mediate segment, each flange presenting at least one side surface oriented so that during impact the substrate fragments impinge against the side surface thereby urging the tool to rotate about its central longitudinal axis.

20. A rotatable cutting tool for impacting and fragmenting a substrate, the tool comprising:

a tool body having a forward end to which a hard insert is affixed, said hard insert including:

an axially forward tip segment, an axially rearward segment, a mediate segment contiguous with both the tip segment and the axially rearward segment;

a plurality of radial flanges extending from the mediate segment, each flange presenting at least one side surface oriented so that during impact the substrate fragments impinge against the side surface thereby urging the tool to rotate about its central longitudinal axis; and said mediate segment includes:

an integral mediate cylindrical portion contiguous with and positioned axially rearwardly of the tip segment;

an integral mediate concave portion contiguous with and positioned axially rearwardly of the mediate cylindrical portion;

an integral mediate frusto-conical portion contiguous with and positioned axially rearwardly of the mediate concave portion; and an integral mediate barrel portion contiguous with and positioned axially rearwardly of the mediate frusto-conical portion.

21. A rotatable cutting tool of claim 20 wherein each flange is contiguous with and extends between the mediate cylindrical portion and the mediate frusto-conical portion.

22. A rotatable cutting tool for impacting and fragmenting a substrate, the tool comprising:

a tool body having a forward end to which a hard insert is affixed, said hard insert including:

an axially forward tip segment, an axially rearward segment, a mediate segment contiguous with both the tip segment and the axially rearward segment;

a plurality of radial flanges extending from the mediate segment, each flange presenting at least one side surface oriented so that during impact he substrate fragment impinge against the side surface thereby urging the tool to rotate about its central longitudinal axis; and each flange includes a top surface and opposite side surfaces contiguous with said top surface and mediate segment, and said top surface is of a concave shape.

23. A rotatable cutting tool for impacting and fragmenting a substrate, the tool comprising:

a tool body having a forward end to which a hard insert is affixed, said hard insert including:

an axially forward tip segment, an axially rearward segment, a mediate segment contiguous with both the tip segment and the axially rearward segment;

a plurality of radial flanges extending from the mediate segment, each flange presenting at least one side surface oriented so that during impact he substrate fragments impinge against the side surface thereby urging the tool to rotate about its central longitudinal axis; and each flange includes a top surface and opposite side surfaces contiguous with said top surface and mediate segment, and each side surface is disposed with respect to the top surface at an angle between about 92° and about 135°.

24. The rotatable cutting tool of claim 23 wherein each side surface is disposed with respect to the top surface at an angle equal to about 100°.

25. A hard insert for use in a rotatable cutting tool wherein the insert is affixed to the forward end of the tool, the hard insert comprising:

a plurality of coaxially aligned and integral segments including a tip segment, a rearward segment, and a mediate segment which is contiguous at the axially forward and thereof with the tip segment and at the axially rearward end thereof with the rearward segment;

a plurality of generally vertically disposed outwardly radially projecting flanges integral with and protruding from the mediate segment; and the mediate comprises:

an integral mediate cylindrical portion contiguous with and positioned axially rearwardly of the tip portion;

an integral mediate concave portion contiguous with and positioned axially rearwardly of the mediate cylindrical portion;

an integral mediate frusto-conical portion contiguous with and positioned axially rearwardly of the mediate concave portion; and an integral mediate barrel portion contiguous with and positioned axially rearwardly of the mediate frusto-conical portion.

26. The hard insert of claim 25 wherein each flange is contiguous with and extends between the mediate cylindrical portion and the mediate frusto-conical portion.

27. The hard insert for use in a rotatable cutting tool wherein the insert is affixed to the forward end of the tool, the hard insert comprising:

a plurality of coaxially aligned and integral segments including a tip segment, a rearward segment, and a mediate segment which is contiguous at the axially forward end thereof with the tip segment and at the axially rearward end thereof with the rearward segment;

a plurality of generally vertically disposed outwardly radially projecting flanges integral with and protruding from the mediate segment;

each flange includes a top surface joining generally planar side surfaces contiguous with the mediate segment and radially extending from the top surface;

the top surface has opposite upper and lower ends; and the width of the upper end of the top surface is less than the width of the lower end of the top surface.

28. The hard insert of claim 27 wherein the width of the top surface increases from the upper to the lower end thereof.

29. A hard insert for use in a rotatable cutting tool wherein the insert is affixed to the forward end of the tool, the hard insert comprising:

a plurality of coaxially aligned and integral segments including a tip segment, a rearward segment, and a mediate segment which is contiguous at the axially forward end thereof with the tip segment and at the axially rearward end thereof with the rearward segment;

a plurality of generally vertically disposed outwardly radially projecting flanges integral with and protruding from the mediate segment;

each flange includes a top surface joining generally planar side surfaces contiguous with the mediate segment and radially extending from the top surface, said side surface is disposed relative to the top surface at an angle between about 92° and about 135°.

30. The hard insert of claim 29 wherein each side surface is disposed relative to the top surface at an angle of about 100°.

* * * * *